United States Patent [19]

Bowman et al.

[11] Patent Number: 4,556,535

[45] Date of Patent: Dec. 3, 1985

[54] PRODUCTION OF ALUMINUM-LITHIUM ALLOY BY CONTINUOUS ADDITION OF LITHIUM TO MOLTEN ALUMINUM STREAM

[75] Inventors: Kenneth A. Bowman, Apollo; John E. Jacoby, Murrysville; Kellen M. Finn, Delmont, all of Pa.

[73] Assignee: Aluminum Company of America, Pittsburgh, Pa.

[21] Appl. No.: 633,616

[22] Filed: Jul. 23, 1984

[51] Int. Cl.[4] ..... C22C 21/00

[52] U.S. Cl. ..... 420/580; 420/528; 420/590; 164/57.1; 266/91

[58] Field of Search ..... 420/528, 580, 590; 164/251, 252, 155, 57.1; 266/91

[56] References Cited

U.S. PATENT DOCUMENTS

| | | | |
|---|---|---|---|
| 3,163,895 | 1/1965 | Dewey | 164/451 |
| 3,468,365 | 9/1969 | Scheffler, Jr. | 164/155 |
| 3,895,937 | 7/1975 | Gjosteen et al. | 75/68 R |
| 4,080,200 | 3/1978 | Sheridan | 75/135 |
| 4,138,246 | 2/1979 | Buxmann et al. | 75/68 R |
| 4,248,630 | 2/1981 | Balmuth | 75/135 |

*Primary Examiner*—Melvyn J. Andrews

*Attorney, Agent, or Firm*—Andrew Alexander; John P. Taylor

[57] ABSTRACT

A continuous process for forming aluminum-lithium alloys is disclosed which comprises continuously monitoring the ingot casting rate and continuously adding a measured and controlled amount of molten lithium beneath the surface of a molten aluminum stream as it flows toward an ingot casting station. The amount of molten lithium to be added is based on the ingot casting rate, the ingot size and the lithium content of the alloy being cast.

12 Claims, 5 Drawing Figures

PRODUCTION OF ALUMINUM-LITHIUM ALLOY BY CONTINUOUS ADDITION OF LITHIUM TO MOLTEN ALUMINUM STREAM

BACKGROUND OF THE INVENTION

1. Field of the Invention

This invention relates to the production of aluminum-lithium alloys. More particularly, this invention relates to an improved process for continuous, in-line addition of molten lithium to a molten aluminum stream to form an aluminum-lithium alloy.

2. Description of the Prior Art

In the production of aluminum base alloys, it is common to add the alloying constituents as solids to molten aluminum in an open melting furnace. The alloying constituents, conventionally in the form of a master metal alloy or pure metals, are usually submerged beneath the surface of the molten aluminum to ensure faster melting with minimum oxidation of the alloying constituents. The molten mixture is then degassed to lower the hydrogen content of the melt by bubbling a gas, such as chlorine, argon and mixtures thereof, through the melt.

The production of aluminum-lithium alloys has become of increasing interest due to the combination of lightweight and high strength which such an alloy can be made to possess. However, the formation of aluminum-lithium alloys is significantly more difficult due to the reaction of aluminum-lithium alloys with refractory linings in the furnace, the rapid rate of oxidation of lithium and the concurrent generation of copious quantities of skim, hydrogen pickup by the molten alloy, objectionable fume evolution and composition gradients in the cast ingot due to the propensity of lithium to oxidize during processing of the molten alloy after the addition of lithium. In conventional processes, as much as 20 wt. % lithium added can be lost due to these undesirable mechanisms.

Attempts have been made to remedy these problems by, for example, adding the lithium to the melt after degassing of the molten aluminum. However, the need for uniformity of composition usually requires stirring which may promote oxidation as well as further hydrogen absorption.

It was, therefore, proposed in Balmuth U.S. Pat. No. 4,248,630 to use a special mixing crucible into which is poured molten aluminum, which has previously been degassed, and a separate stream of molten lithium. The two molten streams are blended together in the mixing crucible under a vacuum or inert atmosphere. After the correct quantities or ratios have been mixed, a valve is opened, and the aluminum-lithium mixture flows into an ingot casting mold.

However, there remains a need for a method of continuous in-line addition and mixing of molten lithium to a molten aluminum stream flowing into an ingot casting mold to ensure maximum uniformity in composition while minimizing oxidation losses, skim formation and hydrogen gas absorption by the molten mixture and lessening the requirements for using expensive refractories and reducing the replacement and maintenance of refractories by reducing the amount of refractory in contact with the molten aluminum-lithium alloy. The present invention resolves these problems and is capable of reducing the lithium loss to 3% or less, which is considered to be a marked advance in the art.

SUMMARY OF THE INVENTION

It is, therefore, an object of this invention to provide a process for the production of aluminum-lithium alloys by continuous addition of molten lithium to a flowing stream of molten aluminum.

It is another object of the invention to provide a process for the production of aluminum-lithium alloys by continuous addition of molten lithium to a flowing stream of molten aluminum by monitoring the alloy flow rate approaching an ingot casting mold wherein the alloy flow rate is determined from the ingot casting rate.

It is yet another object of the invention to provide a process for the production of aluminum-lithium alloys by continuous addition of molten lithium to a flowing stream of molten aluminum by monitoring the alloy flow rate approaching an ingot casting mold wherein the alloy flow rate is determined from the ingot casting rate and the flow of molten lithium is also monitored and adjusted relative to the alloy flow rate to provide a uniform concentration of lithium in the produced alloy.

It is a further object of the invention to provide a process for the production of aluminum-lithium alloys by continuous addition of molten lithium to a flowing stream of molten aluminum by monitoring the alloy flow rate approaching an ingot casting mold.

These and other objects of the invention will be apparent from the accompanying drawings and description of the process.

In accordance with the invention, a continuous process for forming aluminum-lithium alloys is disclosed which comprises continuously adding a measured amount of molten lithium to a molten aluminum stream as it flows toward an ingot casting station.

DESCRIPTION OF THE PREFERRED EMBODIMENTS

Figure 1:
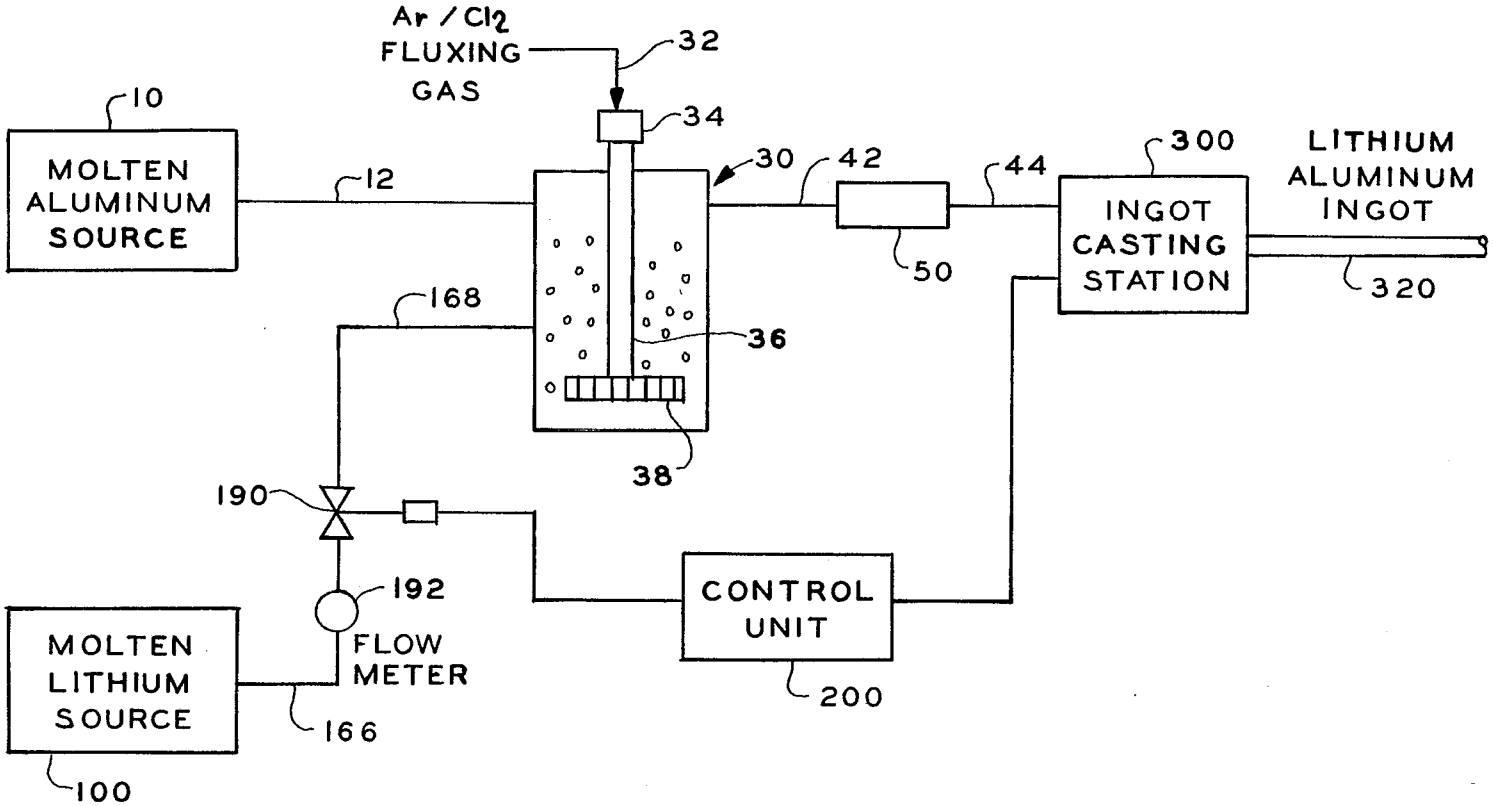
FIG. 1 is a schematic view of the process of the invention.

Referring now to FIG. 1, a continuous process for forming aluminum-lithium alloys is illustrated comprising the continuous controlled blending of molten streams of lithium and aluminum. While the term "molten aluminum" is used herein with reference to the molten metal to be blended with molten lithium, it will be understood that the term is intended to include not only pure aluminum, but also aluminum alloys wherein aluminum has been previously alloyed with other metals prior to the mixing with molten lithium which comprises the present invention.

As shown in FIG. 1, molten aluminum from a source 10 flows via a line or trough 12 to a mixing vessel 30. Said molten aluminum may be optionally degassed in said source 10 prior to flowing to the mixing vessel 30. At the same time, molten lithium from a molten lithium source 100 flows via pipes 166 and 168 to mixing vessel 30. A flow meter 192 and a flow control valve 190 are also provided to respectively monitor and control the flow of molten lithium into mixing vessel 30. Flow control valve 190 is, in turn, controlled by control unit 200, as will be described below.

Figure 2:
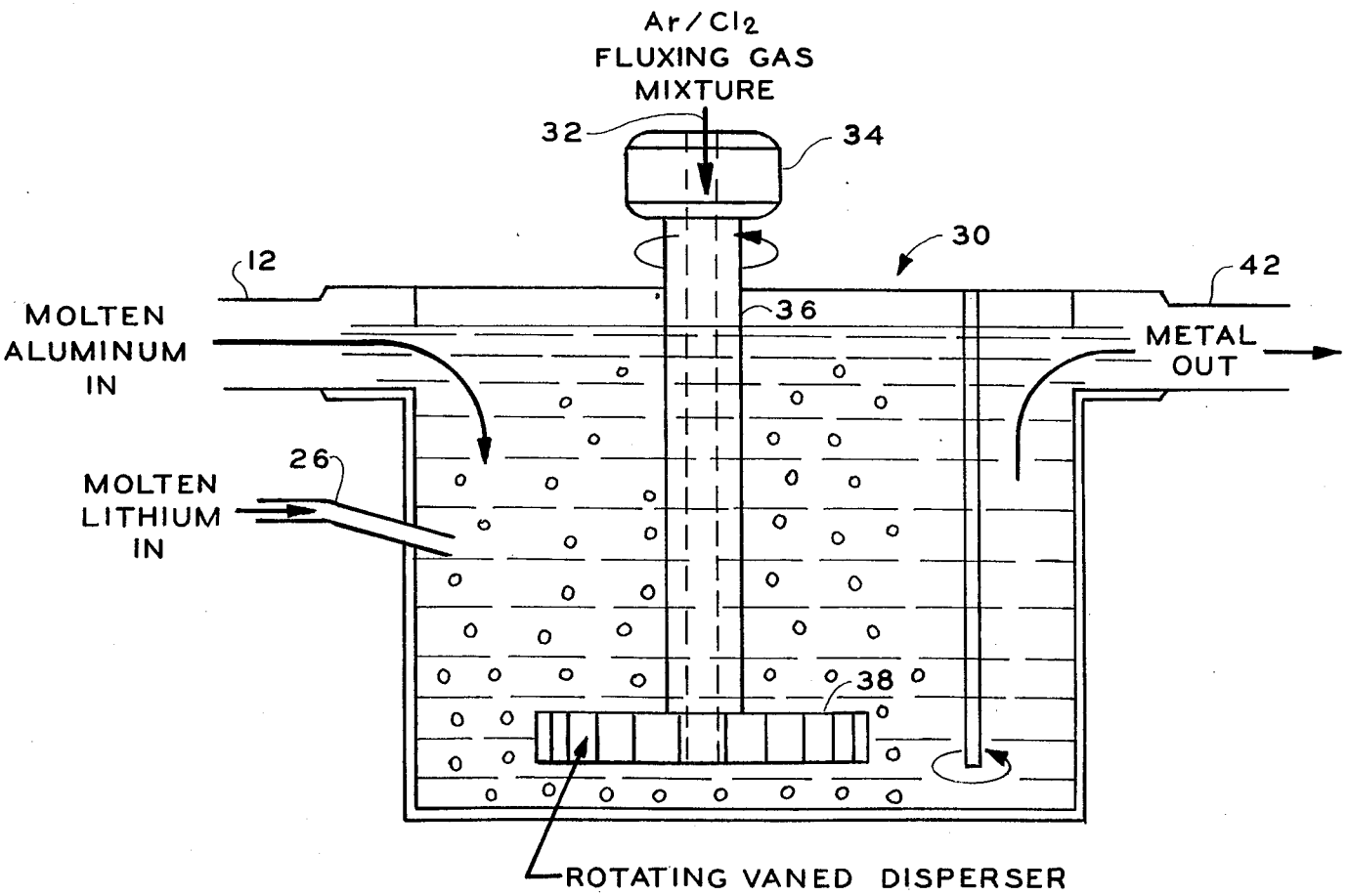
FIG. 2 is a vertical cross section of the mixing chamber used in the process of the invention.

Mixing vessel 30 contains a rotating vaned dispenser 38 on the end of a hollow tube 36 which is coupled to a motor 34 to provide rotation for the rotating vaned dispenser 38. A mixture of argon and chlorine and/or other inert and reactive fluxing gases is fed via line 32 in hollow tube 36 to dispenser 38 for dispersal throughout mixing vessel 30 as vaned dispenser 38 is rotated. The rotation of the dispenser 38 thus serves to thoroughly mix the incoming molten aluminum and molten lithium. It will be noted, in FIG. 2, that entrance port 26, through which the molten lithium flows into vessel 30, is located below the surface of the molten metal within vessel 30 to prevent high lithium content on the surface which could otherwise result in oxidation, fuming and hydrogen pickup.

Mixing vessel 30 provides several additional functions, in addition to proper mixing of the molten lithium, including hydrogen removal and flotation and removal of trace impurities such as sodium and calcium. It should be pointed out that vessel 30 with disperser 38 is illustrative of presently used and commercially available in-line metal treatment systems which cause a high amount of mixing. Thus, an apparatus may be used which introduces a reactive fluxing gas through a rotating disperser, as illustrated, or via a high pressure nozzle. Any such apparatus may be used in connection with the practice of the invention provided that sufficient mixing is imparted so that the exiting mixed alloy is substantially homogeneous. However, as previously noted, the lithium entry port must be modified, if necessary, to insure that the molten lithium enters vessel 30 below the surface of the molten metal.

The molten metal mixture flows out of mixing vessel 30 via line 42 through a filter 50, if desired, and then through trough 44 to ingot casting station 300. The molten metal flows to a mold and is cooled to produce the aluminum-lithium ingot 320. Optionally, the alloy may be filtered between vessel 30 and ingot casting station or mold 300. Several types of filters could be employed including bed filters, disposable refractory foam filters, or cartridge filters. Such troughs, filters and casting molds are all known to those skilled in the respective arts and suitable adaptations to these components to render them compatible with the highly corrosive nature of molten aluminum-lithium alloys will be desired and sometimes necessary.

Figure 3:
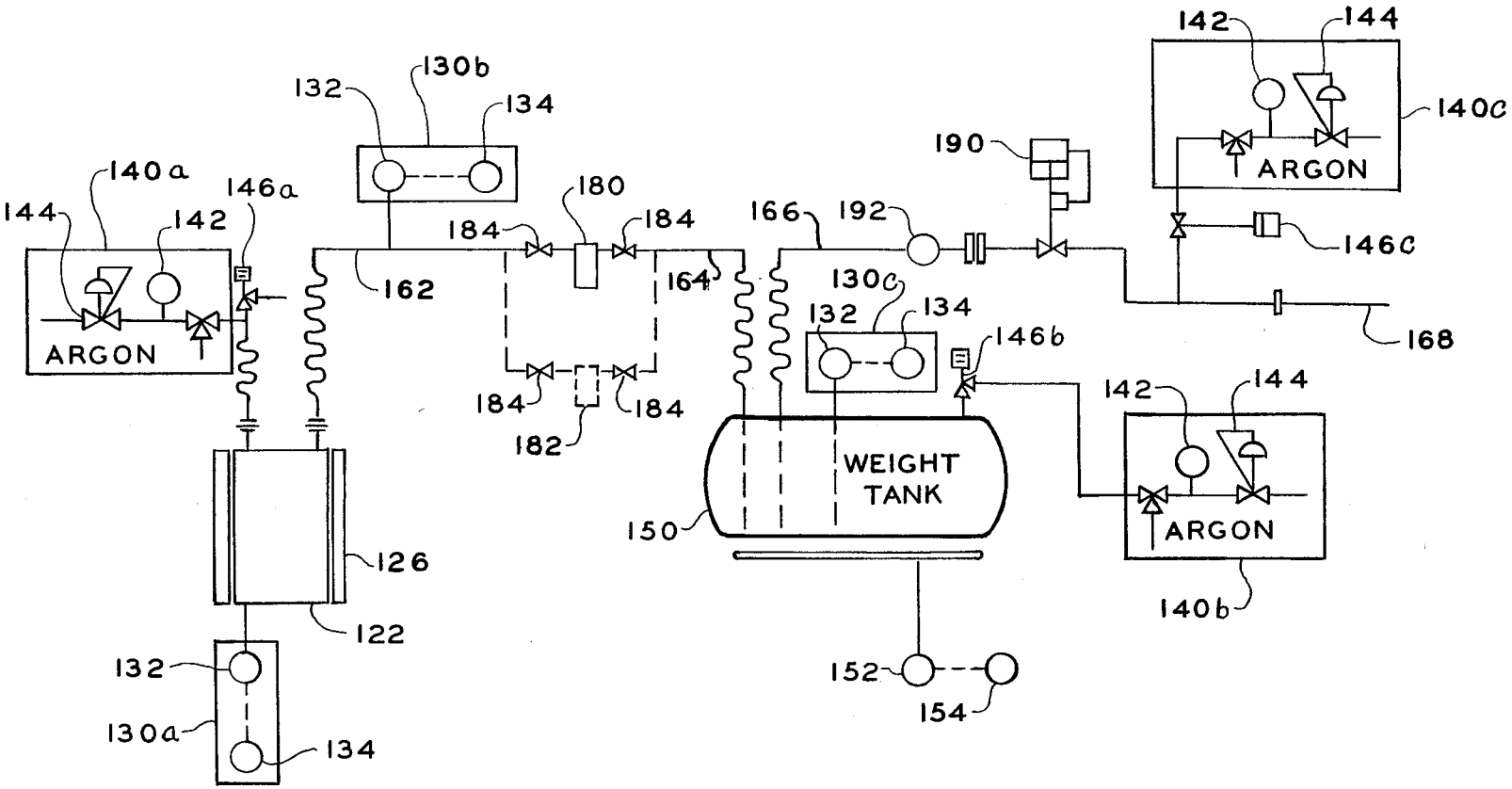
FIG. 3 is a schematic view of the molten lithium source.

Referring now to FIG. 3, a preferred embodiment for supplying the molten lithium source 100 is illustrated in detail. A drum of lithium 122 is heated by clam shell heater 126 to melt the lithium. The temperature of the lithium is sensed by temperature sensor **130*a* which comprises a temperature sensing element 132 and a temperature indicator control 134 which transmits the sensed temperature to control unit 200. The temperature is maintained at slightly above the melting point of lithium, i.e., above 186° C. The molten lithium is maintained under an atmosphere of inert gas such as argon gas from an argon supply unit 140*a* which comprises a pressure indicator 142*a* used to monitor the pressure and a control valve 144*a* through which the gas flows into drum 122 via piping 124. The inert gas is maintained below approximately 10 psi. A pressure relief valve 146*a*** is provided to vent any excess pressures.

The molten lithium is made to flow from drum 122 through heated supply line 162 by argon pressure, or other pumping means, such as mechanical or electromagnetic pumps. A second temperature element **130*b* is located in supply line 162 to measure the temperature of the supply line to ensure that it has been preheated to a temperature greater than 186° C. A filter 180 may also be provided as well as an auxilliary filter 182. Auxilliary filter 182 is used when removing filter 180 for cleaning or replacement. Valves 184 permit alternatively directing the lithium flow between filters 180 and 182**.

Supply line 164 transports the molten lithium from filter 180 to a weighing tank 150 wherein the amount of lithium is electronically weighed via weight indicator 154, and the amount is transmitted to control unit 200 via weight transmitter 152. The temperature of the molten lithium within weighing tank 150 is monitored by temperature sensor **130*c*. The molten lithium flows out of weighing tank 150 via supply line 166 which carries the molten lithium through a flow indicator 192 and a flow control valve 190. Flow indicator 192 may comprise a commercially available electromagnetic mass flow meter. This type of flow meter is particularly suited for measuring the flows of molten metal in pipes because the meter does not contact the flowing metal and the system can, therefore, be kept closed. From flow control valve 190, the molten lithium flows via line 168 to mixing vessel 30. It will be understood that the foregoing describes a preferred method for supplying molten lithium to mixing vessel 30**. Other methods may be used provided, however, that adequate precautions are taken to minimize lithium losses.

It will be noted that weighing tank 150 is also connected to an argon gas supply source **140*b*. Argon supply source 140*b* is used for pressurizing lithium weigh tank 150 so that lithium can be pushed by argon pressure up transfer line 166. The argon pressure effectively is the pump for transferring the molten lithium. However, as noted earlier, other pumping means, e.g., mechanical and electromagnetic pumps or even gravity flow, may be used. It will be further noted that yet another argon supply source 140*c*** is provided to flush or purge the lines of molten lithium if shutdown of the metering system is desired.

Figure 4:
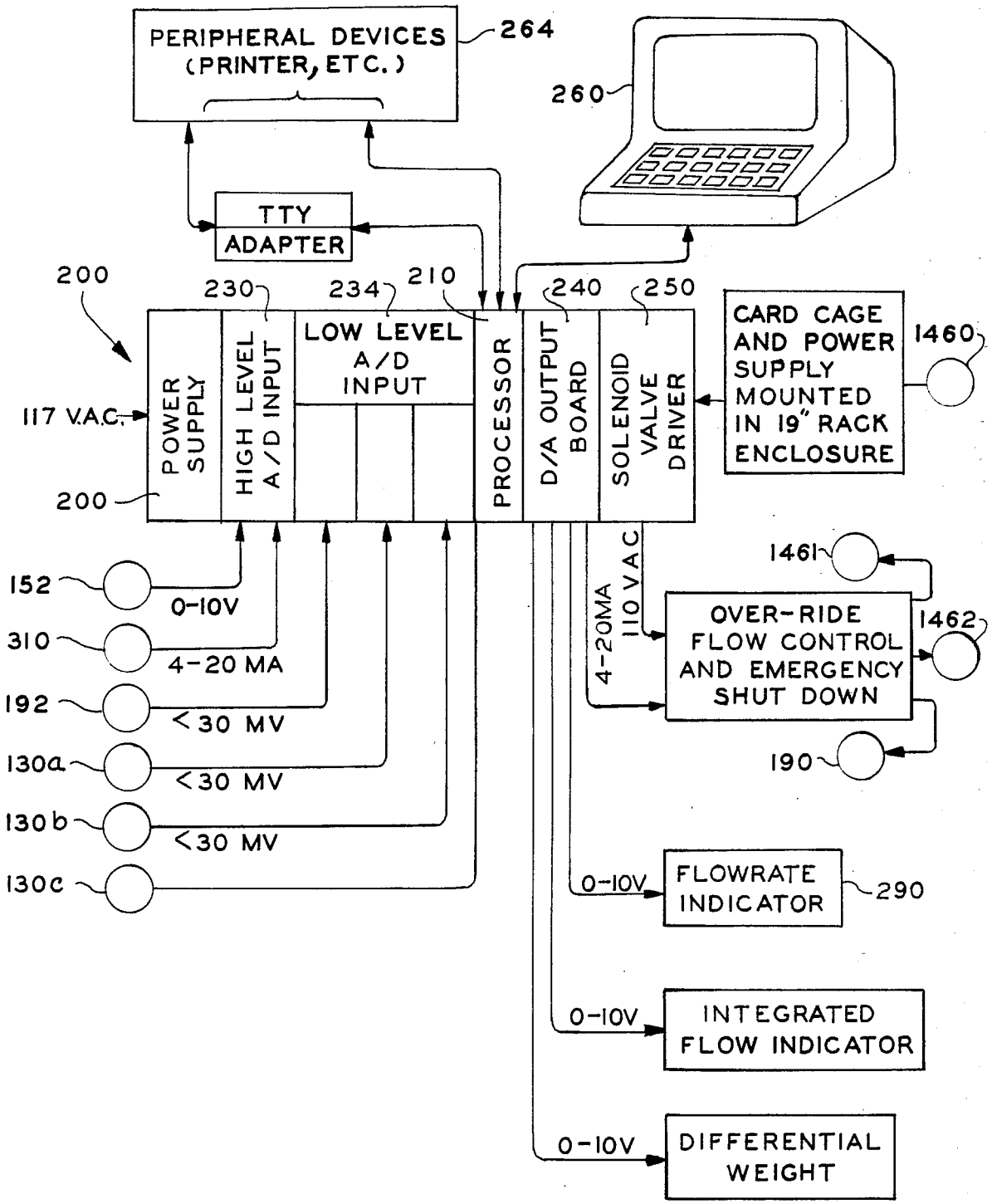
FIG. 4 is a schematic view of the control unit utilized in the process of the invention.

Control unit 200, in a preferred embodiment, may comprise a control system utilizing a microprocessor to monitor the casting rate and control the lithium addition. As shown in FIG. 4, control unit 200 may comprise a microprocessor 210 including a power supply 220, high level analog/digital input 230, low analog/digital input 234, high analog/digital output 240, and solenoid valve driver 250.

The measured weight of lithium, as measured by weight indicator 154, is fed as an input into control unit 200 via weight transmitter 152. The flow rate of the molten lithium, as measured by flow indicator 192, is fed into control unit 200 as well as the temperature of the molten lithium as measured by temperature sensing units **130*a*, 130*b* and 130*c*. Further information, such as the density of the molten aluminum-lithium alloy and cross-sectional area of the mold in ingot casting station 300, may be inputted via terminal 260. The ingot casting rate, as measured by a linear casting transducer 310, is also inputted into control unit 200**.

Also inputted, via CRT terminal 260, is the desired lithium concentration to be added to the aluminum. The control unit 200 provides output indicators either on CRT terminal 260 or via a printer 264 showing the flow rate, weight and the like. Control unit 200 also controls flow control valve 190 via solenoid valve driver 250 to maintain the correct amount of molten lithium flowing through valve 190 into mixing chamber 30 based on the input parameters of ingot casting rate, density of aluminum, cross-sectional area of mold and desired ratio of aluminum to lithium. Alternatively, if these computations have previously been done, the lithium flow rate can be entered as a function of the ingot casting rate.

Figure 5:
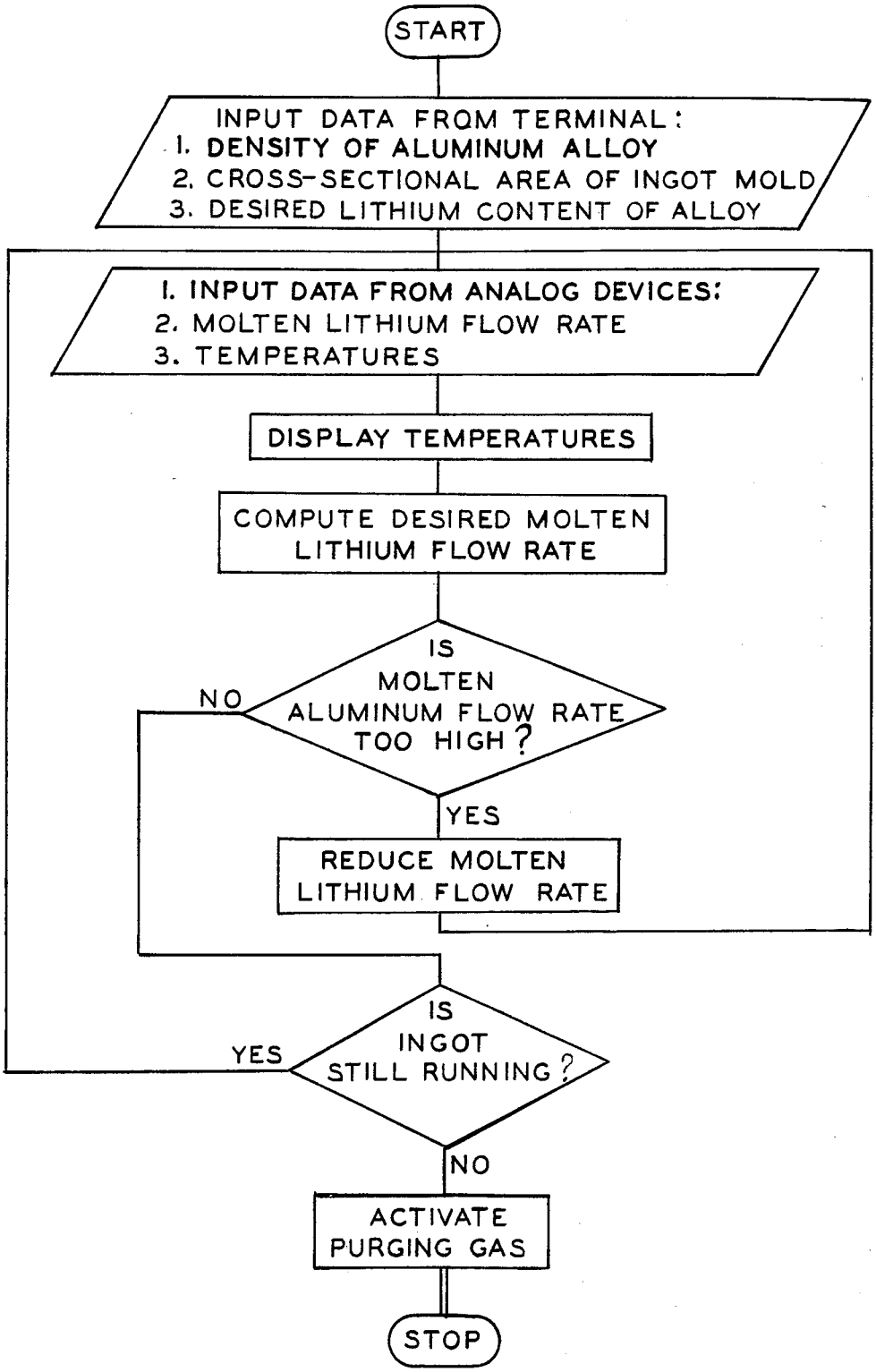
FIG. 5 is a flow chart showing the process of the invention.

As shown in the flow chart of FIG. 5, the density of the molten aluminum-lithium alloy and the cross-sectional area of the ingot casting mold are inputted into control unit 200 via terminal 260 along with the desired concentration of lithium to be added. The casting rate of the aluminum-lithium alloy ingot is compared with the lithium flow rate inputted from lithium flow meter 192. A signal is then outputted to flow control valve 190 to either increase or decrease the flow of molten lithium into mixing vessel 30. If the system needs to be shut down, flow control valve 190 is shut and valve **146*c* is opened to purge transfer line 168** with argon gas.

Thus, the invention provides an improved process for the continuous production of an aluminum-lithium alloy of predetermined lithium content wherein molten streams of aluminum and lithium are blended together. Oxidation of the lithium and composition gradients due to oxidation or burn-off of the lithium are mitigated. Furthermore, by adding the lithium to the molten aluminum on a continuous basis as the ingot is cast, the composition control from the butt to the head of the ingot should be homogeneous since any lithium losses in the system should be uniform, in contrast to batch mixing operations. Furthermore, the size of the mixing vessel in the instant invention need not be as large as prior art batch processes since there is no need to contain, in one vessel, all the metal which will be cast. It will be appreciated that aluminum is easily contained by inexpensive refractories, and lithium is easily contained in metal containers. However, the aluminum-lithium alloy requires for containment very costly refractories. Thus, it will be seen that it is important to minimize the size of the mixing vessel in order to decrease refractory costs. Also, it will be noted that the smaller the mixing vessel, the easier it is to seal the vessel in order to maintain a protective atmosphere over the aluminum-lithium melt. Additionally, the size of the mixing vessel does not determine the size of the ingot cast. That is, in the subject process, the ingot can be cast as large as desired without consideration for the size of the mixing vessel as in a batch process. For example, applicants have used a mixing vessel capable of containing 1400 pounds of aluminum-lithium melt and have cast therefrom a 9000 pound aluminum lithium ingot which was only limited by the size of the casting facility used. It will be appreciated that this results in lower processing costs from the standpoint of amount of refractory lining needed to contain the molten alloy. The result is a more economical process for producing a homogeneous aluminum-lithium alloy with process losses significantly reduced with respect to prior art processes for producing aluminum-lithium alloys.

Having thus described the invention, what is claimed is:

1. An improved process for forming aluminum-lithium alloys which comprises continuously adding a measured amount of molten lithium to a molten aluminum stream flowing to an ingot casting mold wherein the predetermined physical quantities of aluminum-lithium alloy density and the ingot casting mold cross-sectional area are used together with the instantaneously and continuously monitored ingot casting rate to determine the amount of lithium to be added to said molten aluminum stream to thereby produce an aluminum-lithium alloy ingot with minimal composition variation with respect to lithium along the length of the ingot.

2. The process of claim 1 including passing said molten aluminum alloy stream and said molten lithium through a mixing chamber having mixing means therein to provide high shear.

3. The process of claim 2 wherein said molten aluminum and molten lithium streams are blended in an inert gas atmosphere.

4. The process of claim 1 wherein the flow of molten lithium is controlled by a flow control valve in the molten lithium stream which is adjusted responsive to variations in the ingot casting speed.

5. An improved method for producing an aluminum-lithium alloy characterized by reduced process losses including losses from oxidation and reduced hydrogen gas absorption which comprises:

(a) continuously monitoring the ingot casting rate of molten aluminum-lithium alloy;

(b) continuously monitoring the flow rate of molten lithium into a molten aluminum stream;

(c) introducing molten lithium beneath the surface of an agitated source of molten aluminum while bubbling an inert gas through the molten metal mixture; and (d) adjusting the rate of flow of said molten lithium based on the monitored ingot casting rate and molten lithium flow rate to maintain a predetermined concentration of lithium in the aluminum-lithium alloy ingot being cast.

6. The process of claim 5 which further includes monitoring the temperature of the molten lithium being introduced into the molten aluminum stream.

7. The process of claim 6 including the further step of monitoring the weight of the molten lithium being introduced into the molten aluminum stream.

8. The process of claim 7 which further includes bubbling a fluxing gas through the molten aluminum-lithium alloy to remove impurities.

9. The process of claim 8 which includes the step of continuously introducing molten lithium into molten aluminum while subjecting the mixture to high shear forces to thoroughly mix the two metals to insure uniform concentration of the lithium in the aluminum-lithium alloy.

10. The process of claim 8 wherein argon gas under pressure is used to force said flow of molten lithium into said molten aluminum.

11. The process of claim 7 which further includes bubbling a mixture of argon and chlorine gases through the molten aluminum-lithium alloy to remove impurities, including hydrogen.

12. An improved method for producing a continuously cast aluminum-lithium alloy ingot characterized by reduced process losses including losses from oxidation and reduced hydrogen gas absorption which comprises:

(a) continuously adding molten lithium to molten aluminum in a mixing vessel by introducing said molten lithium beneath the surface of said molten aluminum;

(b) continuously monitoring the flow rate of said molten lithium into said molten aluminum;

(c) subjecting the molten aluminum-lithium mixture to high shear forces in said mixing vessel to thoroughly mix the two metals to insure uniform concentration of the lithium in the aluminum-lithium alloy;

(d) bubbling a mixture of argon and chlorine gases through the molten aluminum-lithium alloy in said mixing vessel to remove impurities including hydrogen;

(e) continuously casting an aluminum-lithium alloy ingot while monitoring the ingot casting rate of said molten aluminum-lithium alloy; and (f) adjusting the rate of flow of said molten lithium into said mixing vessel based on the monitored ingot casting rate and molten lithium flow rate to maintain a predetermined concentration of lithium in said aluminum-lithium alloy ingot being cast.

* * * * *